US010856066B2

(12) United States Patent
Lee et al.

(10) Patent No.: US 10,856,066 B2
(45) Date of Patent: Dec. 1, 2020

(54) EARPHONE DEVICE

(71) Applicants: Peng Lee, New Taipei (TW); Yi-Wen Liu, New Taipei (TW)

(72) Inventors: Peng Lee, New Taipei (TW); Yi-Wen Liu, New Taipei (TW)

(73) Assignee: XROUND INC., New Taipei (TW)

( * ) Notice: Subject to any disclaimer, the term of this patent is extended or adjusted under 35 U.S.C. 154(b) by 0 days.

(21) Appl. No.: 16/299,419

(22) Filed: Mar. 12, 2019

(65) Prior Publication Data

US 2019/0289387 A1 Sep. 19, 2019

Related U.S. Application Data

(60) Provisional application No. 62/643,791, filed on Mar. 16, 2018.

(51) Int. Cl.

| | |
|---|---|
| ***G10K 11/178*** | (2006.01) |
| ***H04R 3/00*** | (2006.01) |
| ***H04R 1/10*** | (2006.01) |
| ***H04R 1/08*** | (2006.01) |

(52) U.S. Cl.

CPC ..... *H04R 1/1083* (2013.01); *G10K 11/17885* (2018.01); *H04R 1/083* (2013.01); *H04R 1/1016* (2013.01); *H04R 1/1041* (2013.01); *H04R 3/005* (2013.01); *G10K 2210/1081* (2013.01); *G10K 2210/3216* (2013.01); *H04R 2420/07* (2013.01); *H04R 2460/01* (2013.01)

(58) Field of Classification Search

CPC .. H04R 1/1083; H04R 1/1016; H04R 1/1041; H04R 3/005; H04R 2420/07; H04R 2460/01; H04R 1/1008; G10K 11/17885; G10K 2210/3216; G10K 11/002

USPC ..... 381/71.1, 58, 71.6

See application file for complete search history.

(56) References Cited

U.S. PATENT DOCUMENTS

| | | | | |
|---|---|---|---|---|
| 9,497,530 | B1 * | 11/2016 | Campbell | G06F 16/636 |
| 2013/0114821 | A1 * | 5/2013 | Hamalainen | G10K 11/002 381/71.6 |
| 2017/0112671 | A1 * | 4/2017 | Goldstein | A61B 5/6817 |
| 2019/0080682 | A1 * | 3/2019 | Darlington | H04R 1/1083 |
| 2019/0110120 | A1 * | 4/2019 | Sapozhnykov | H04R 1/1008 |

* cited by examiner

*Primary Examiner* — Vivian C Chin
*Assistant Examiner* — Ubachukwu A Odunukwe

(57) ABSTRACT

The invention discloses an earphone device comprising a first case, a first speaker unit, a first recording unit, and a second recording unit. The first speaker unit, disposed inside the first case, emits a first testing sound signal according to a test command. The first recording unit, disposed inside the first case, records a first environment sound signal according to a record command or a noise cancelling command. The second recording unit, disposed inside the first case, records a first feedback sound signal, related to the first testing sound signal, according to the test command.

10 Claims, 6 Drawing Sheets

EARPHONE DEVICE

CROSS REFERENCE TO RELATED APPLICATION

The present application claims priority to U.S. provisional application Ser. No. 62/643,791 filed on, Mar. 16, 2018, and the entire content of which is incorporated by reference to this application.

BACKGROUND OF THE INVENTION

1. Field of the Invention

The present invention is related to an earphone device, especially related to an earphone device having functions of active noise cancellation, stereo recording, and otoacoustic emissions test.

2. Description of the Prior Art

With the development of mobile devices, consumers nowadays can frequently watch or listen to media for hours. In order to fit all kinds of usage scenarios and make the consumers enjoy the media in high quality, a lot of earphone devices with various functions are provided. Therefore, general consumers can choose earphone devices according to their requirements. For example, some of the earphone devices may emphasize its bass performance, which might be chosen by the consumers who particularly enjoy bass in the media; some of the earphone devices may emphasize its noise cancellation ability, which might be chosen by the consumers who usually watch or listen to the media while commuting; and some of the earphone devices may emphasize its recording quality, which might be chosen by the consumers who usually call through their earphone devices.

However, the commercially available earphone devices are still limited for advanced consumers. The advanced consumers need customized earphone devices. For example, the professional gamer might need earphone devices with higher resolution for sound source location. The movie creator might need earphone devices with stereo recording function. Therefore, the industry needs an earphone device having functions of active noise cancellation and stereo recording, and the earphone device can provide customized listening experience.

SUMMARY OF THE INVENTION

The invention provides an earphone device, microphones of the earphone device can be used for active noise cancellation and environmental recording. Therefore, users can record video or audio media directly without external microphones. Besides, the earphone device has function of otoacoustic emissions (OAE) test, and the earphone device can provide customized listening experience by analyzing users' hearing ability at different frequencies.

The present invention provides an earphone device comprising a first case, a first speaker unit, a first recording unit, and a second recording unit. The first speaker unit, disposed inside the first case, emits a first testing sound signal according to a test command. The first recording unit, disposed inside the first case, records a first environment sound signal according to a record command or a noise cancelling command. The second recording unit, disposed inside the first case, records a first feedback sound signal, related to the first testing sound signal, according to the test command.

In some embodiments, the earphone device can have a processing unit, the processing unit is coupled with the first speaker unit, the first recording unit, and the second recording unit, and the processing unit provides the test command, the record command, and the noise cancelling command. In addition, the processing unit can further provide a first noise cancelling sound signal according to the first environment sound signal, the first speaker unit emits the first noise cancelling sound signal according to the noise cancelling command. Besides, the earphone device can have a second case, a second speaker unit, a third recording unit, and a fourth recording unit. The second speaker unit, disposed inside the second case, can emit a second testing sound signal according to the test command. The third recording unit, disposed inside the second case, can record a second environment sound signal according to the record command or the noise cancelling command. The fourth recording unit, disposed inside the second case, can record a second feedback sound signal, related to the second testing sound signal, according to the test command. Moreover, the processing unit can further provide a second noise cancelling sound signal according to the second environment sound signal, the second speaker unit emits the second noise cancelling sound signal according to the noise cancelling command. Wherein the first environment sound signal and the second environment sound signal are configured to produce a stereo recording signal.

In some embodiments, the processing unit further calculates a first sound compensating factor according to the first feedback sound signal. In addition, the first feedback sound signal can comprise a first feedback frequency and a second feedback frequency, the processing unit further calculates the first sound compensating factor according to the volume decibel of the first feedback sound signal at the first feedback frequency and the volume decibel of the first feedback sound signal at the second feedback frequency. Besides, the first testing sound signal comprises a first testing frequency and a second testing frequency, the first testing frequency is lower than the second testing frequency, and the volume decibel of the first testing sound signal at the first testing frequency is not less than the volume decibel of the first testing sound signal at the second testing frequency. Moreover, the frequency difference between the first feedback frequency and the first testing frequency is substantially the same as the frequency difference between the second feedback frequency and the second testing frequency. Alternatively, the frequency difference between the first feedback frequency and the second testing frequency is substantially the same as the frequency difference between the second feedback frequency and the first testing frequency.

In summary, the earphone device disclosed in the present invention can utilize hardware efficiently. For example, same microphones of the earphone device can be used for active noise cancellation and environmental recording. Therefore, users can record video or audio media directly without external microphones. Besides, the earphone device has function of otoacoustic emissions (OAE) test, and the earphone device can provide customized listening experience by analyzing users' hearing ability at different frequencies.

BRIEF DESCRIPTION OF THE APPENDED DRAWINGS

DETAILED DESCRIPTION OF THE INVENTION

The features, objections, and functions of the present invention are further disclosed below. However, it is only a few of the possible embodiments of the present invention, and the scope of the present invention is not limited thereto, that is, the equivalent changes and modifications are done in accordance with the claims of the present invention will remain the subject of the present invention. Without departing from the spirit and scope of the invention, it should be considered as further enablement of the invention.

Figure 1:
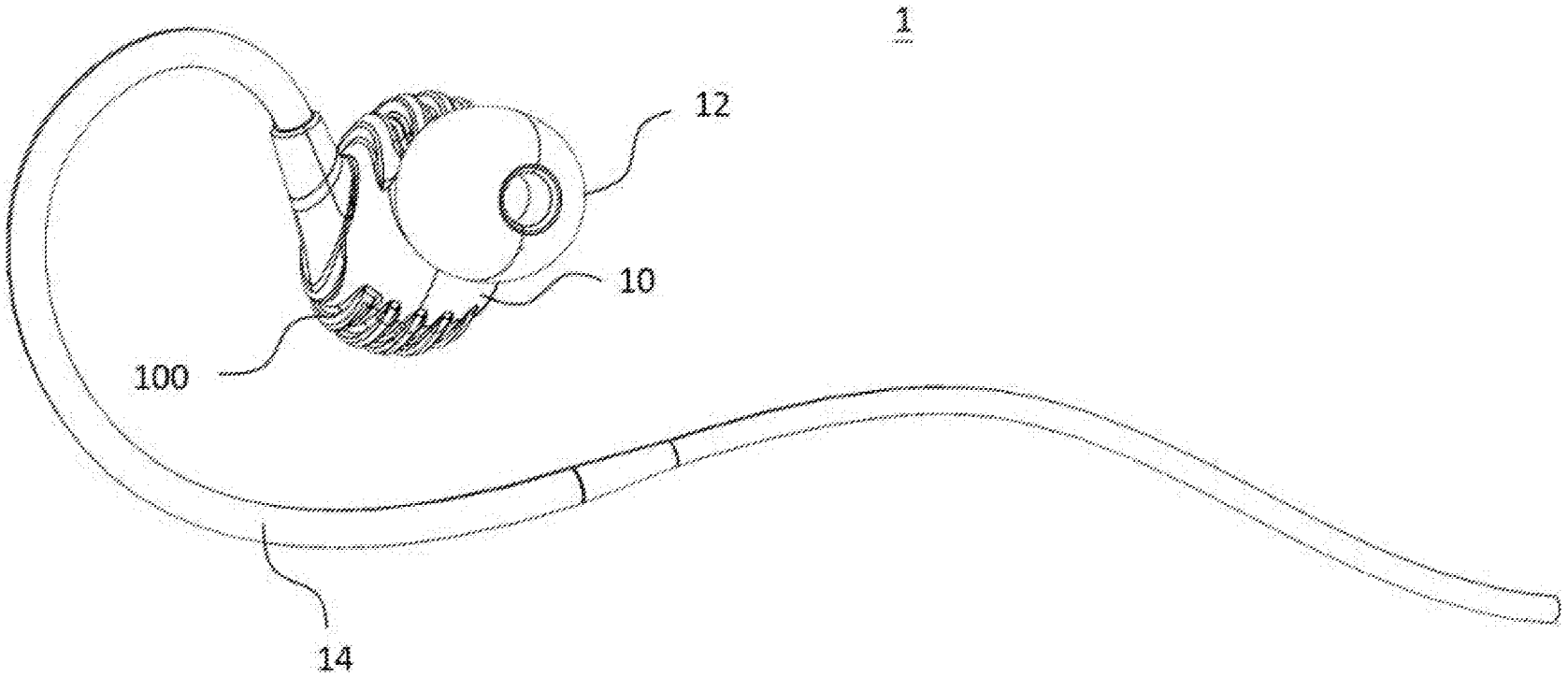
FIG. 1 is a schematic perspective view of an earphone device in accordance with an embodiment of the present invention.
Figure 2:
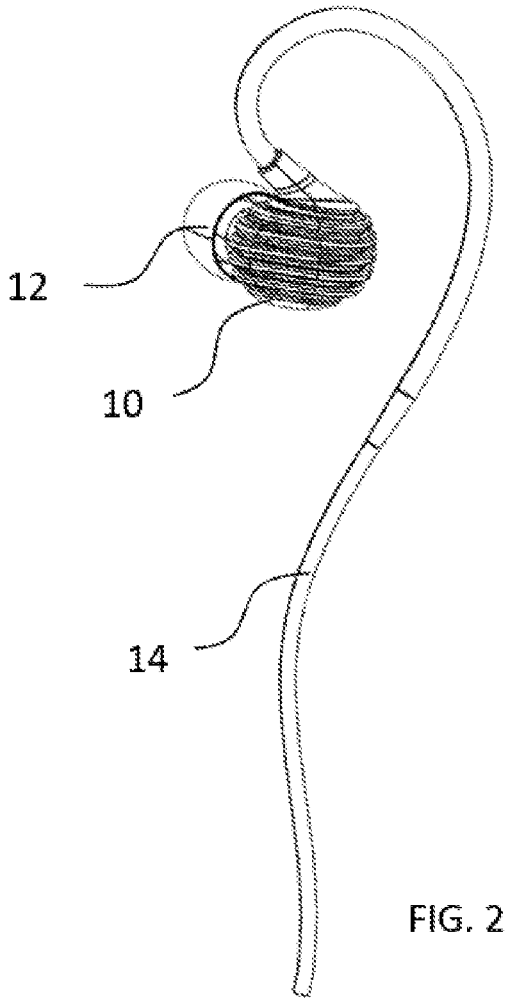
FIG. 2 is another schematic perspective view of the earphone device in accordance with an embodiment of the present invention.

Please refer to FIG. 1 and FIG. 2, FIG. 1 is a schematic perspective view of an earphone device in accordance with an embodiment of the present invention, and FIG. 2 is another schematic perspective view of the earphone device in accordance with an embodiment of the present invention. As shown in figures, the earphone device 1 can comprise a case 10 (first case), an earbud 12, and a transmission line 14. The case 10 can be made of metal or plastic. For example, the case 10 can be integrally formed by plastic injection molding process. The present embodiment does not limit the internal structure of the case 10, and how the earbud 12 and the transmission line 14 are assembled with the case 10. In an embodiment, the case 10 can have a hollow protrusion (not shown in FIG. 1), the hollow protrusion can transmit sound through an inner hole, and the earbud 12 can be detachably socketed on an outer surface of the hollow protrusion.

In the embodiment shown in FIG. 1 and FIG. 2, the earbud 12 is socketed on the case 10, and the earphone device 1/the earbud 12 can be put inside the ear canal. In other words, the earphone device 1 can be an in-ear earphone, and the earbud 12 can be made of flexible material such as soft plastic, rubber, or silicone rubber. Said flexible material can fit the contour/shape of the ear canal not only to increase the wearing comfortableness, but also to reduce sound leakage by filling the ear canal. Because the earbud 12 is socketed on the case 10, the case 10 can substantially be fixed outside the ear when the earbud 12 is substantially be fixed inside the ear canal. To be noted, the contour of the case 10 is not limited in the present embodiment, and the earbud 12 is not a necessary component. For example, the case 10 can have other structure to contact the ear directly without the earbud 12. Such as, the earphone device 1 of the present embodiment can be, but not limited to, an on-ear earphone or a supra-aural earphone, and can be placed at the pinna or cover the whole ear.

The outer surface of the case 10 shown in FIG. 1 can have several ribs disposed separately. The ribs, disposed on the outer surface of the case 10, can be aesthetic and functional. For example, users can hold the case 10 and put the earbud 12 inside the ear canal. The ribs can prevent the case 10 from slipping off users' hand, and can help users to adjust holding position. Besides, the case 10 shown in FIG. 1 can be connected with the transmission line 14, that the earphone device 1 can be a wired earphone device. The transmission line 14 can be configured to transmit commands and signals. In an embodiment, the earphone device 1 may not need the transmission line 14, but use the wireless technology, e.g., Bluetooth, to transmit commands and signals.

In addition, it is apparent to the one having ordinary skill in the art that the earphone device 1 shown in FIG. 1 can be worn on the left ear or the right ear. For example, the present embodiment shows that the earphone device 1 is worn on the left ear. To be noted, the earphone device 1 can also have a symmetrical portion to be worn on the right ear (not shown in FIG. 1), so that the user can wear the earphone device 1 on the left ear and the right ear at the same time. In order to make the people skilled in the art understand easily, the concept of the earphone device 1 shown in FIG. 1 is used in the following embodiments for clarity of description.

Figure 3:
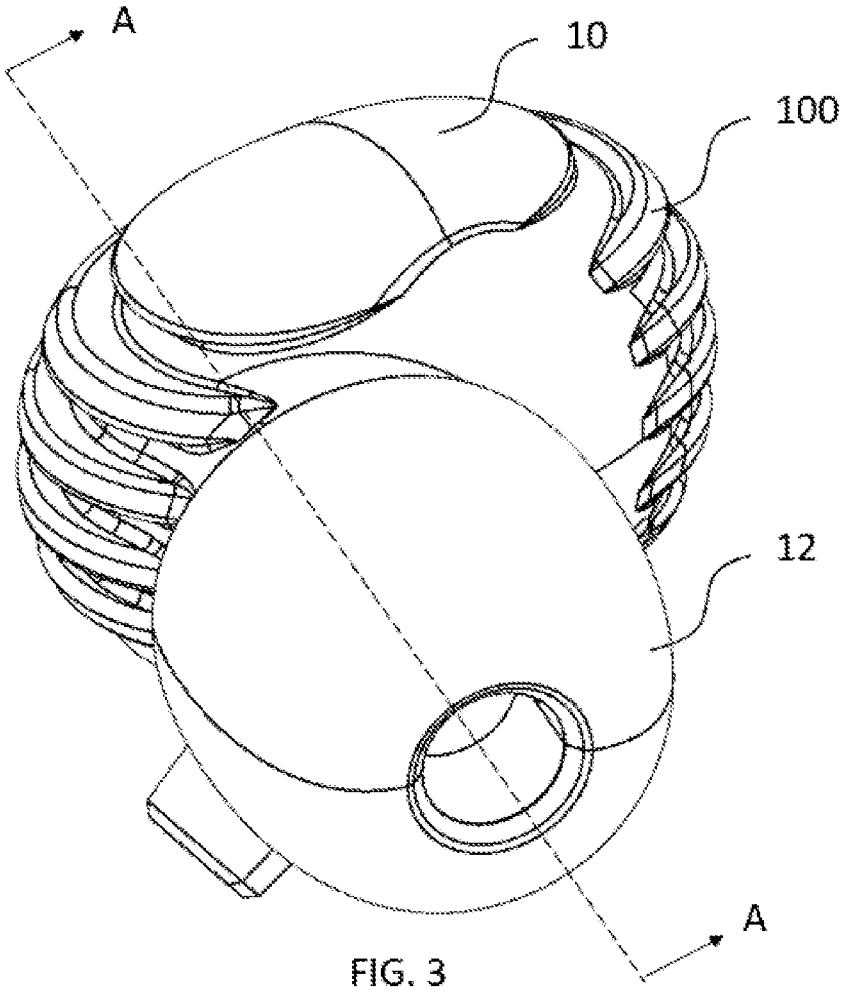
FIG. 3 is a partial schematic perspective view of the earphone device in accordance with an embodiment of the present invention.
Figure 4:
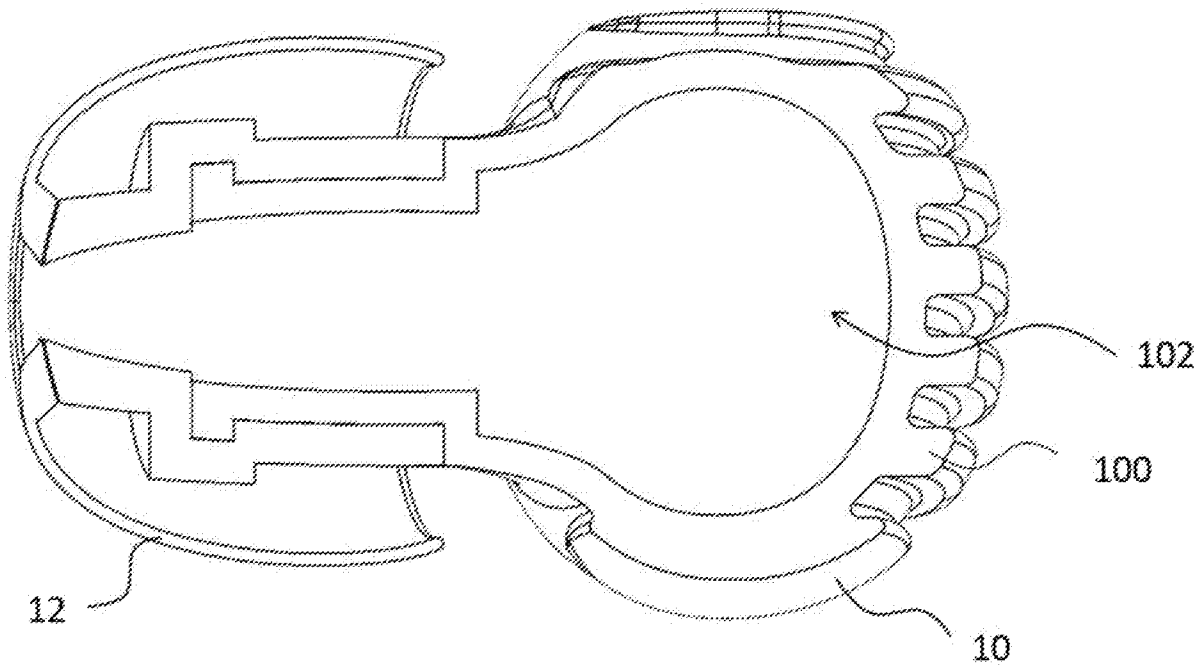
FIG. 4 is a section view of the earphone device along AA line in FIG. 3 in accordance with an embodiment of the present invention.

Please refer to FIG. 3 and FIG. 4, FIG. 3 is a partial schematic perspective view of the earphone device in accordance with an embodiment of the present invention, and FIG. 4 is a section view of the earphone device along AA line in FIG. 3 in accordance with an embodiment of the present invention. As shown in figures, the case 10 can be hollow and have an accommodation space 102 inside. The accommodation space 102 can be separated into several speaker cavities by one or more components. For example, the accommodation space 102 shown in FIG. 4 can be separated by partitions, flexible materials, or a speaker unit (not shown in FIG. 4), and the accommodation space 102 can be, but not limited to, separated into a front speaker cavity, a rear speaker cavity, or more speaker cavities. Besides, the case 10 is not necessary to be airtight, and the case 10 can have one or more leak ports. The embodiment does not limit the quantity of the leak ports.

Figure 5:
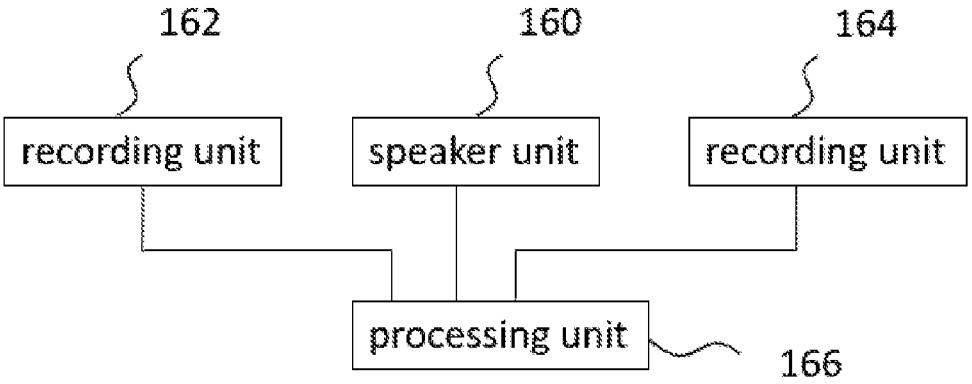
FIG. 5 is a block diagram of the earphone device in accordance with an embodiment of the present invention.

Moreover, in order to explain functions of the earphone device 1, please refer to FIG. 1, FIG. 4, and FIG. 5, FIG. 5 is a block diagram of the earphone device in accordance with an embodiment of the present invention. As shown in figures, the accommodation space 102 can be located inside the case 10, and a speaker unit 160 (first speaker unit), a recording unit 162 (first recording unit), and a recording unit 164 (second recording unit) can be accommodated within the accommodation space 102. The speaker unit 160, the recording unit 162, and the recording unit 164 can be electrically connected to a processing unit 166. In practice, the speaker unit 160 can be a loudspeaker for converting electrical signals into corresponding sound, and the recording unit 162 and the recording unit 164 can be microphones for converting sound into electrical signals. The processing unit 166 can be a micro processing unit (MCU) or a computing chip. In an embodiment, the processing unit 166 can be, but not limited to, disposed inside the accommodation space 102. The processing unit 166 can be disposed outside the case 10, and the speaker unit 160, the recording unit 162, and the recording unit 164 can be electrically connected to the processing unit 166 through the transmission line 14. For example, the processing unit 166 can be disposed inside a remote control or other assembly of the earphone device 1.

The speaker unit 160 can be disposed inside the case 10, a part of the accommodation space 102 on one side of the speaker unit 160 can be defined as the front speaker cavity, and the other part of the accommodation space 102 on the other side of the speaker unit 160 can be defined as the rear speaker cavity. For example, the front speaker cavity can be defined as the accommodation space 102 between the speaker unit 160 and the earbud 12, and the rear speaker cavity can be defined as the rest of the accommodation space 102. In an embodiment, the recording unit 162 can be disposed in the rear speaker cavity, and the recording unit 164 can be disposed in the front speaker cavity. When the earbud 12 is put inside the ear canal, the recording unit 162 can receive more sound from outside the ear, and the recording unit 164 can receive more sound from inside the ear.

The earphone device 1 can have a testing mode and an operating mode. When the earphone device 1 works in the testing mode, the earphone device 1 can measure the hearing ability at certain frequency of the user. In an embodiment, the speaker unit 160 can emit a first testing sound signal according to a test command. Taking the user wearing the earphone device 1 on the left ear as an example, the first testing sound signal can be related to the left ear, and can be continuous testing sound signal covering one or more frequencies. In practice, the first testing sound signal can be, but not limited to, a standard signal for measuring otoacoustic emission. Besides, when the earphone device 1 works in the operating mode, the first speaker unit can emit a first sound track signal of a media according to a play command, and the media can be music, voice, or other sound data. In an embodiment, the media, supporting stereo formats, can have a left track signal and a right track signal. The left track signal and the right track signal can be corresponded to the left part and the right part of the earphone device. For example, the speaker unit 160 can receive and play the left track signal of the media.

In an embodiment, when user's ear (e.g., left ear) receives the first testing sound signal, user's ear may respond a first feedback sound signal. The first feedback sound signal can be a reflected signal when user's ear is stimulated by the first testing sound signal. The present embodiment does not limit how the first feedback sound signal is generated, the first feedback sound signal can be generated by resonance or reflection of the ear membrane, or can be generated by resonance or reflection of the combination of the ear membrane and other physiological structures, such as ear bone or canal. When the earphone device 1 works in the testing mode, the recording unit 164 can record the first feedback sound signal according to the test command. In practice, the first feedback sound signal can be analyzed by the processing unit 166 for determining user's hearing ability at certain frequencies. The processing unit 166 can further calculate a first sound compensating factor according to the first feedback sound signal.

For example, when the earphone device 1 works in the testing mode, the processing unit 166 discovers user's hearing ability is lower than average at 1000 Hz after analyzing the first feedback sound signal, e.g., user's hearing ability is 3 dB lower than average at 1000 Hz. The processing unit 166 can record information such as "1000 Hz" and "3 dB" in the first sound compensating factor. In an embodiment, the first sound compensating factor can record user's hearing ability corresponding to auditory frequency range, such as all frequencies between 20 Hz to 20000 Hz. When the earphone device 1 play music in the operating mode, the processing unit 166 can compensate the music at each and every frequency between 20 Hz to 20000 Hz according to the first sound compensating factor. For example, the processing unit 166 can increase the sound of the music 3 dB or more at 1000 Hz to compensate user's hearing ability which is 3 dB lower than average at 1000 Hz. In other words, user can hear the correct volume of the music at every frequency, and therefore enhance the hearing experience. The present embodiment does not limit how the processing unit 166 compensates the hearing ability.

In detail, the first testing sound signal, emitted by the speaker unit 160, can cover two main frequencies, such as a first testing frequency f1 and a second testing frequency f2. The second testing frequency f2 can be higher than the first testing frequency f1, and the volume decibel of the first testing sound signal at the first testing frequency f1 is larger than the volume decibel of the first testing sound signal at the second testing frequency f2. For example, the second testing frequency f2 may be 1.1 to 1.3, preferably 1.2, times the first testing frequency f1. And, the volume decibel of the first testing sound signal at the first testing frequency f1 is 6 dB to 14 dB, preferably 10 dB, larger than the volume decibel of the first testing sound signal at the second testing frequency f2. Moreover, the first testing sound signal is configured to measure user's hearing ability at a certain frequency, said frequency may be substantially twice the first testing frequency f1 minus the second testing frequency f2, which means said frequency can be 2f1−f2.

To be noted, the recording unit 164 can record the first feedback sound signal at a plurality of frequency. When the first testing frequency f1 and the second testing frequency f2 are set, the processing unit 166 can analyze and record the first feedback sound signal at said frequency (2f1−f2). And the first sound compensating factor is related to the volume decibel of the first feedback sound signal at said frequency (2f1−f2). By changing first testing frequency f1 and the second testing frequency f2, said frequency (2f1−f2) analyzed and recorded by the processing unit 166 can change correspondingly. Therefore, user's hearing ability corresponding to auditory frequency range, such as all frequencies between 20 Hz to 20000 Hz, can be measured.

Because the first testing sound signal, covering one or more frequencies, can be continuously or simultaneously emitted by the speaker unit 160, it might have some issues about intermodulation distortion. Therefore, the first feedback sound signal recorded by the recording unit 164 can have distortion at a specific frequency (first feedback frequency). In order to compensate the issues about intermodulation distortion, the processing unit 166 can further check the first feedback sound signal at another specific frequency (second feedback frequency). The first feedback frequency and the second feedback frequency can be symmetrical. Because the first feedback frequency is located at twice the first testing frequency f1 minus the second testing frequency f2, there are several definition of "symmetrical". For example, the frequency difference between the first feedback frequency and the first testing frequency can be substantially the same as the frequency difference between the second feedback frequency and the second testing frequency. Alternatively, the frequency difference between the first feedback frequency and the second testing frequency can be substantially the same as the frequency difference between the second feedback frequency and the first testing frequency.

In an embodiment, after the first feedback frequency and the second feedback frequency are calculated, the processing unit 166 can analyze the volume decibel of the first feedback sound signal at the first feedback frequency and the volume decibel of the first feedback sound signal at the second feedback frequency. Then, the volume decibel of the first feedback sound signal at the second feedback frequency can be considered as the intermodulation distortion, so that the first sound compensating factor can be calculated based on the volume decibel of the first feedback sound signal at the first feedback frequency minus the volume decibel of the first feedback sound signal at the second feedback frequency.

Moreover, the earphone device 1 can not only measure user's hearing ability, but also have other functions. For example, the earphone device 1 can perform functions of recording and noise cancelling. Please refer to FIG. 1, FIG. 4, and FIG. 5, the recording unit 162 can record environmental sound (first environment sound signal) about the left ear according to a record command or a noise cancelling command. As mentioned above, when the earbud 12 is put inside the ear canal, the recording unit 162 can receive more sound from outside the ear, and the recording unit 164 can receive more sound from inside the ear. In practice, the case 10 may have leak ports, the recording unit 162 can be exposed to the outer surface of the case 10 through the leak ports, and the recording unit 162 can record the environmental sound efficiently.

In an embodiment, the earphone device 1 can further have a recording mode, and the processing unit 166 can command the recording unit 162 to record environmental sound in the operating mode and the recording mode. In practice, in order to reduce noise heard by the user, the earphone device 1 can provide active noise cancelling function in the operating mode. For example, the processing unit 166 can sense the noise from the first environment sound signal, such as low frequency noise which can be heard by human, and provide a first noise cancelling sound signal accordingly. Said noise and the first noise cancelling sound signal can have the same frequency and amplitude, but have opposite phases. Then, the speaker unit 160 emits the first noise cancelling sound signal according to the noise cancelling command, so that said noise can be compensated by the first noise cancelling sound signal. Of course, when the earphone device 1 is playing music, the first sound track signal can be already compensated with the first noise cancelling sound signal by the processing unit 166, and the speaker unit 160 emits the compensated first sound track signal of a media according to a play command.

As mentioned above, the processing unit 166 can command the recording unit 162 to record environmental sound in the recording mode. Traditional earphone usually needs an external recording equipment to realize the recording function. For example, the traditional earphone may have a microphone inside its remote control. However, the external recording equipment certainly increase the cost, and it is clearly not convenient to use the external recording equipment. Besides, if the microphone is hidden inside its remote control, the recording quality might be low, and the main issue is that the location of the microphone is not the location of the ear, so that the recorded sound is not likely to create an immersive effect. The recording unit 162 of the present embodiment is integrated in the case 10, and the recording unit 162 can be used for both noise cancelling and recording, the earphone device 1 does not need the external microphone only for recording. Moreover, because the recording unit 162 is close to the ear, the sound recorded by the recording unit 162 is more like the sound can actually be heard.

Figure 6:
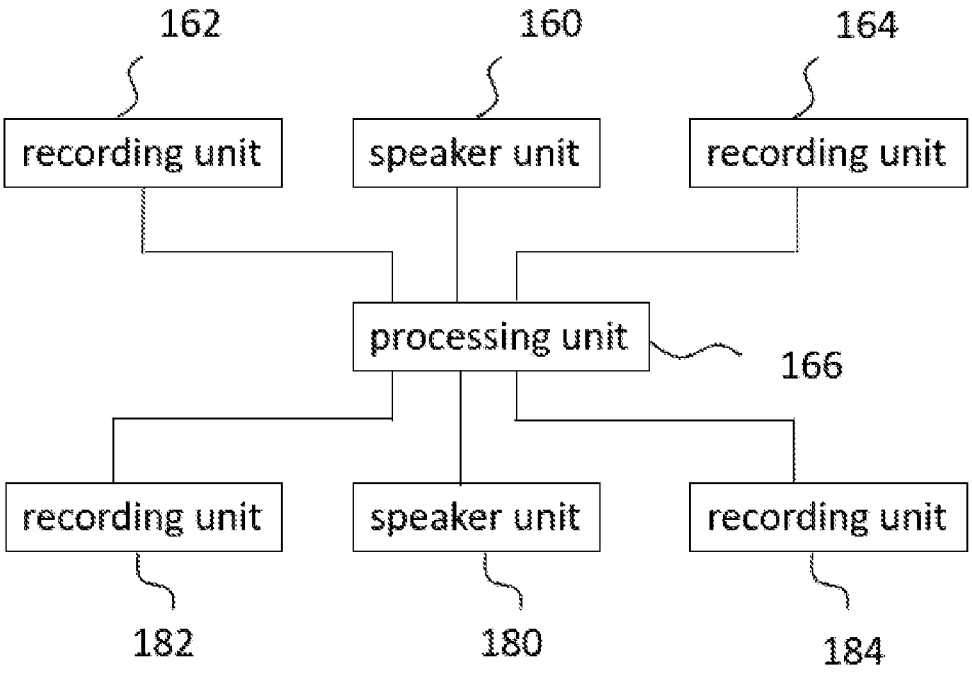
FIG. 6 is a block diagram of the earphone device in accordance with another embodiment of the present invention.

As mentioned above, FIG. 1 can be the left ear part of the earphone device 1. In fact, the earphone device 1 can be worn in two ears. Therefore, the earphone device 1 can have another speaker unit and another 2 recording units. Please refer to FIG. 5 and FIG. 6, FIG. 6 is a block diagram of the earphone device in accordance with another embodiment of the present invention. As shown in figures, the earphone device 1 can have the speaker unit 160, the recording unit 162, the recording unit 164, the speaker unit 180 (second speaker unit), the recording unit 182 (third recording unit), and the recording unit 184 (fourth recording unit). The same as FIG. 5, the speaker unit 180 can be a loudspeaker for converting electrical signals into corresponding sound, and the recording unit 182 and the recording unit 184 can be microphones for converting sound into electrical signals. The speaker unit 180, the recording unit 182, and the recording unit 184 can be electrically connected to a processing unit 166. In practice, the earphone device 1 can have another case (second case, not shown in figures), and the speaker unit 180, the recording unit 182, and the recording unit 184 can be accommodated in the second case.

The speaker unit 180 can also emit a second testing sound signal according to the test command, the second testing sound signal can also be related to the right ear, and can be continuous testing sound signal covering one or more frequencies. The recording unit 182 can also record environmental sound about the right ear (a second environment sound signal) according to the record command or the noise cancelling command. The recording unit 184 can also record a second feedback sound signal related to the right ear according to the test command, and the second feedback sound signal can be related to the second testing sound signal. In other words, the speaker unit 180, the recording unit 182, and the recording unit 184 can be the right ear part of the earphone device 1. The function of the speaker unit 160 is substantially the same as the speaker unit 180 thereof. The function of the recording unit 162 is substantially the same as the recording unit 182 thereof. The function of the recording unit 184 is substantially the same as the recording unit 184 thereof.

In practice, when the earphone device 1 works in the testing mode, the speaker unit 160 and the speaker unit 180 can respectively emit the first testing sound signal and the second testing sound signal according to the test command. The recording unit 164 and the recording unit 184 can respectively record the first feedback sound signal and the second feedback sound signal according to the test command. The processing unit 166 can further calculate the first sound compensating factor and the second sound compensating factor according to the first feedback sound signal and the second feedback sound signal respectively. Besides, when the earphone device 1 works in the operating mode, the processing unit 166 can sense the noise from the first environment sound signal and the second environment sound signal, such as low frequency noise which can be heard by human, and provide the first noise cancelling sound signal and the second noise cancelling sound signal accordingly. Of course, when the earphone device 1 is playing music, the first sound track signal can be already compensated with the first noise cancelling sound signal, and the second sound track signal can be already compensated with the second noise cancelling sound signal by the processing unit 166, and the speaker unit 160 and the speaker unit 180 can emit the compensated first sound track signal and the compensated second sound track signal of a media according to a play command.

Moreover, when the earphone device 1 works in the recording mode, the processing unit 166 can combine the first environment sound signal and the second environment sound signal to create a stereo recording sound. Because the recording unit 162 and the recording unit 182 are close to the left ear and the right ear respectively, the sound recorded by the recording unit 162 and the recording unit 182 should be more like the sound can actually be heard. Thus, the stereo recording sound recorded by the earphone device 1 can have great immersive effect due to the better locations of the recording unit 162 and the recording unit 182.

In summary, the earphone device disclosed in the present invention can utilize hardware efficiently. For example, same microphones of the earphone device can be used for active noise cancellation and environmental recording. Therefore, users can record video or audio media directly without external microphones. Besides, the earphone device has function of otoacoustic emissions (OAE) test, and the earphone device can provide customized listening experience by analyzing users' hearing ability at different frequencies.

What is claimed is:

1. An earphone device, comprising:

a first case;

a second case;

a first speaker unit, disposed inside the first case, emitting a first testing sound signal according to a test command;

a first recording unit, disposed inside the first case, recording a first environment sound signal according to a record command or a noise cancelling command;

a second recording unit, disposed inside the first case, recording a first feedback sound signal, related to the first testing sound signal, according to the test command;

a second speaker unit, disposed inside the second case, emitting a second testing sound signal according to the test command;

a third recording unit, disposed inside the second case, recording a second environment sound signal according to the record command or the noise cancelling command;

a fourth recording unit, disposed inside the second case, recording a second feedback sound signal, related to the second testing sound signal, according to the test command; and a processing unit coupled with the first speaker unit, the first recording unit, and the second recording unit, and providing the test command, the record command, and the noise cancelling command, wherein the second recording unit further records a third environment sound signal according to the noise cancelling command, the processing unit further provides a first noise cancelling sound signal according to the first environment sound signal and the third environment sound signal, the first speaker unit emits the first noise cancelling sound signal according to the noise cancelling command.

2. The earphone device according to claim 1, wherein the processing unit further provides a second noise cancelling sound signal according to the second environment sound signal, the second speaker unit emits the second noise cancelling sound signal according to the noise cancelling command.

3. The earphone device according to claim 2, wherein the first speaker unit further emits a first sound track signal of a media according to a play command, and the second speaker unit further emits a second sound track signal of the media according to the play command.

4. The earphone device according to claim 3, wherein the first sound track signal is compensated with the first noise cancelling sound signal, and the second sound track signal is compensated with the second noise cancelling sound signal.

5. The earphone device according to claim 1, wherein the first environment sound signal and the second environment sound signal are configured to produce a stereo recording signal.

6. The earphone device according to claim 1, wherein the processing unit further calculates a first sound compensating factor according to the first feedback sound signal.

7. The earphone device according to claim 6, wherein the first feedback sound signal comprises a first feedback frequency and a second feedback frequency, the processing unit further calculates the first sound compensating factor according to the volume decibel of the first feedback sound signal at the first feedback frequency and the volume decibel of the first feedback sound signal at the second feedback frequency.

8. The earphone device according to claim 7, wherein the first testing sound signal comprises a first testing frequency and a second testing frequency, the first testing frequency is lower than the second testing frequency, and the volume decibel of the first testing sound signal at the first testing frequency is not less than the volume decibel of the first testing sound signal at the second testing frequency.

9. The earphone device according to claim 8, wherein a frequency difference between the first feedback frequency and the first testing frequency is the same as the frequency difference between the second feedback frequency and the second testing frequency.

10. The earphone device according to claim 8, wherein a frequency difference between the first feedback frequency and the second testing frequency is the same as the frequency difference between the second feedback frequency and the first testing frequency.

* * * * *